US011155080B2

(12) United States Patent
Misumi et al.

(10) Patent No.: US 11,155,080 B2
(45) Date of Patent: Oct. 26, 2021

(54) CLEANING METHOD OF LIQUID DISCHARGE HEAD AND LIQUID DISCHARGE APPARATUS

(71) Applicant: CANON KABUSHIKI KAISHA, Tokyo (JP)

(72) Inventors: Yoshinori Misumi, Tokyo (JP); Maki Kato, Fuchu (JP); Yuzuru Ishida, Yokohama (JP); Tsubasa Funabashi, Oita (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/924,031

(22) Filed: Jul. 8, 2020

(65) Prior Publication Data

US 2021/0016563 A1 Jan. 21, 2021

(30) Foreign Application Priority Data

Jul. 16, 2019 (JP) ..... JP2019-131444

(51) Int. Cl.
*B41J 2/045* (2006.01)
*B41J 2/165* (2006.01)

(52) U.S. Cl.
CPC ..... *B41J 2/04541* (2013.01); *B41J 2/0458* (2013.01); *B41J 2/16517* (2013.01)

(58) Field of Classification Search
CPC .. B41J 2/16517; B41J 2/0458; B41J 2/14072; B41J 2/14129
USPC ..... 347/5, 9, 14, 22, 23, 26
See application file for complete search history.

(56) References Cited

U.S. PATENT DOCUMENTS 9,527,290 B2 * 12/2016 Yoshinari ..... B41J 2/14032
9,630,399 B2 * 4/2017 Ishida ..... B41J 2/04513
10,434,777 B2 * 10/2019 Kato ..... B41J 2/165

FOREIGN PATENT DOCUMENTS

JP 2012-101557 A 5/2012

* cited by examiner

*Primary Examiner* — An H Do
(74) *Attorney, Agent, or Firm* — Canon U.S.A., Inc., IP Division

(57) ABSTRACT

A method of cleaning a liquid discharge head includes first eluting a first electrode and second eluting a second electrode. In the cleaning method, the first eluting and the second eluting are executed such that a ratio between a first electric power amount used in the first eluting and a second electric power amount used in the second eluting is a ratio based on a ratio between an area of a first face of the first electrode and an area of a second face of the second electrode.

15 Claims, 16 Drawing Sheets

CLEANING METHOD OF LIQUID DISCHARGE HEAD AND LIQUID DISCHARGE APPARATUS

BACKGROUND OF THE INVENTION

Field of the Invention

The present disclose relates to a cleaning method of a liquid discharge head for discharging liquid and a liquid discharge apparatus for discharging liquid.

Description of the Related Art

Currently, a liquid discharge apparatus which discharges liquid droplets from a discharge port through bubble generating energy is widely used. This type of liquid discharge apparatus heats liquid inside a liquid chamber by supplying electric power to a heat generating resistor, and makes the liquid bubble up in the liquid chamber through film boiling caused by the application of heat. When the above-described liquid discharge apparatus is used, a region on the heat generating resistor may be affected by physical action such as impact caused by cavitation, which occurs when bubbles arise, shrink, and disappear in the liquid. Since the heat generating resistor is held at a high temperature while the liquid is being discharged, a region on the heat generating resistor may be affected by chemical action. In the chemical action, liquid ingredients are thermally decomposed, and the decomposed ingredients firmly adhere to or accumulate on a surface of the heat generating resistor. To protect the heat generating resistor from the above-described physical action or chemical action, a protection layer that covers the heat generating resistor is arranged.

On a thermal action portion, which is in contact with the liquid, of the protection layer arranged on the heat generating resistor, a phenomenon such as adsorption of low-soluble substances occurs. In the phenomenon, a color material and an additive substance contained in the liquid are decomposed at a molecular level and transformed into the low-soluble substances by being heated at high temperature, and these low-soluble substances are physically adsorbed to the thermal action portion. This phenomenon is referred to as "scorching". When scorching occurs in the thermal action portion, heat is unevenly transmitted to the liquid from the thermal action portion, and thus there is a risk in which liquid bubbling becomes unstable.

In order to solve the above-described disadvantage, Japanese Patent Application Laid-Open No. 2012-101557 discusses a cleaning processing of a liquid discharge head. In the cleaning processing, a protection layer that covers a heat generating resistor is eluted into ink (liquid) using electrochemical reaction between the ink and the protection layer, so that a scorched substance is removed. Japanese Patent Application Laid-Open No. 2012-101557 also discusses a method for executing the cleaning processing. In the method, the protection layer is arranged to serve as one electrode, and a portion electrically connectable to the protection layer via ink is arranged to serve as another electrode. Then, voltage is applied between the two electrodes in a state where polarities of these electrodes are inverted. With this method, the scorched substance is removed from the electrodes, and the ink bubbling becomes stable. Accordingly, durability of the liquid discharge head can be improved.

SUMMARY OF THE INVENTION

According to an aspect of the present disclose, a method of cleaning a liquid discharge head includes a heat generating resistor for discharging liquid inside a flow path, a first electrode having a first face exposed to the flow path, which covers the heat generating resistor, and a second electrode having a second face exposed to the flow path. The method of cleaning the liquid discharge head includes first eluting the first electrode by applying voltage between the first electrode and the second electrode via a liquid, and second eluting the second electrode by applying voltage between the first electrode and the second electrode via the liquid. The first eluting and the second eluting are executed such that a ratio between a first electric power amount used in the first eluting and a second electric power amount used in the second eluting is based on a ratio between an area of the first face and an area of the second face.

Further features of the present disclose will become apparent from the following description of exemplary embodiments with reference to the attached drawings.

DESCRIPTION OF THE EMBODIMENTS

In Japanese Patent Application Laid-Open No. 2012-101557, when cleaning processing of a liquid discharge head discussed is executed, the first electrode and a second electrode may be eluted into the liquid by different elution amounts. The first electrode is configured of a protection layer that covers a heat generating resistor. The second electrode is capable of applying voltage to the first electrode via liquid. In particular, when there is a considerable difference between elution amounts of the first and the second electrodes and the cleaning processing of the liquid discharge head is executed periodically, there may be a risk in that one of the electrodes is consumed earlier than another electrode and the cleaning processing cannot be executed any more. Accordingly, the difference between the elution amounts of the first and the second electrodes may be a factor that hinders improvement in durability of the liquid discharge head.

The present disclose is directed to a technique of improving durability of a liquid discharge head by reducing a difference between elution amounts of a first and a second electrodes while cleaning processing is executed.

Exemplary embodiments of the present disclose will be described with reference to the appended drawings.

The present exemplary embodiments have a configuration of a liquid discharge apparatus (e.g., recording apparatus) in which liquid (e.g., ink) is circulated between a tank and the liquid discharge apparatus. However, a configuration thereof is not limited thereto. For example, the liquid discharge apparatus may have a configuration in which ink can flow inside a pressure chamber without circulating ink. In this configuration, two tanks are arranged on an upstream side and a downstream side of the liquid discharge apparatus, and ink is delivered from one tank to another tank. Further, The present exemplary embodiments are also applicable to a liquid discharge apparatus that does not have the below-described collection port.

The present exemplary embodiments include a so-called line-type print head having a physical length corresponding to a width of a recording medium. However, the present disclose is also applicable to a so-called serial-type liquid discharge apparatus that executes recording while executing scanning on the recording medium. The serial-type liquid discharge apparatus may have, for example, respective single recording element substrates for black ink and color inks. However, the present invention is not limited to the above, and is also applicable to a short line-type print head having a length shorter than a width of a recording medium. This line-type print head has several recording element substrates arranged in such a way that discharge ports thereof overlap with each other in a discharge port row direction, and is configured to execute scanning on a recording medium.

<Liquid Discharge Apparatus>

Figure 1:
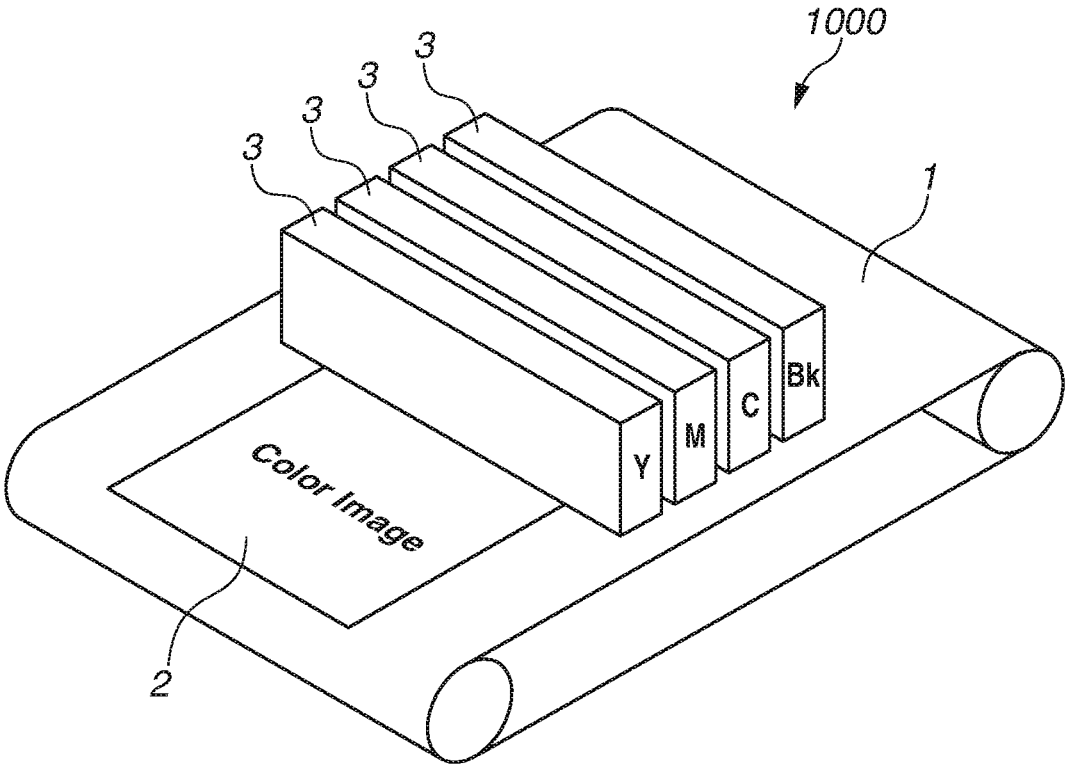
FIG. 1 is a schematic diagram illustrating a configuration of a liquid discharge apparatus.

FIG. 1 is a schematic diagram illustrating a configuration of an apparatus for discharging liquid, to which a first exemplary embodiment of the present disclose is applicable, particularly illustrating a configuration of a liquid discharge apparatus 1000 (hereinafter, also referred to as "recording apparatus 1000") which discharges ink to execute recording. The liquid discharge apparatus 1000 is a line-type recording apparatus including a conveyance unit 1 for conveying a recording medium 2 and a line-type liquid discharge head 3 arranged in a direction approximately orthogonal to a conveyance direction of the recording medium 2. The liquid discharge apparatus 1000 continuously or intermittently conveys a plurality of recording media 2 to execute continuous recording in a single-pass. The recording medium 2 is not limited to a cut sheet and may be a continuous roll sheet. The liquid discharge apparatus 1000 is equipped with liquid discharge heads 3 that correspond to respective ink colors of cyan (C), magenta (M), yellow (Y), and black (K), so that full-color printing can be executed thereby. Further, a liquid supply unit serving as a supply path for supplying liquid to the liquid discharge head 3, a main tank, and a buffer tank are fluidly connected to each of the liquid discharge heads 3. Furthermore, an electric control unit, which transmits power and a discharge control signal to each of the liquid discharge heads 3, is electrically connected thereto.

<Liquid Discharge Head>

Figure 2A:
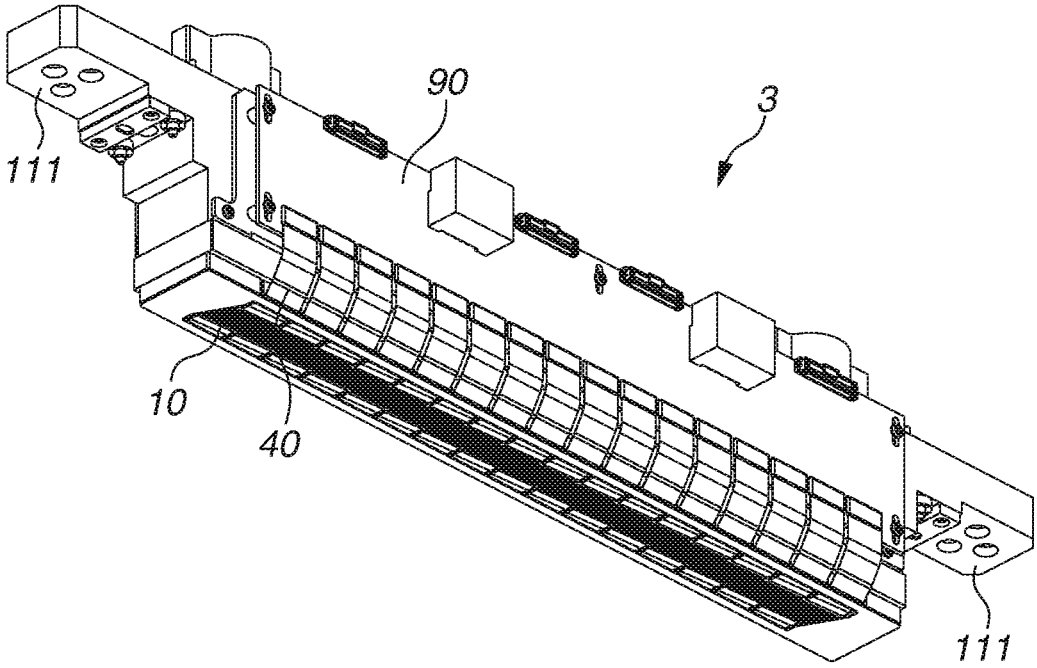
FIGS. 2A and 2B are perspective views of a liquid discharge head.
Figure 2B:
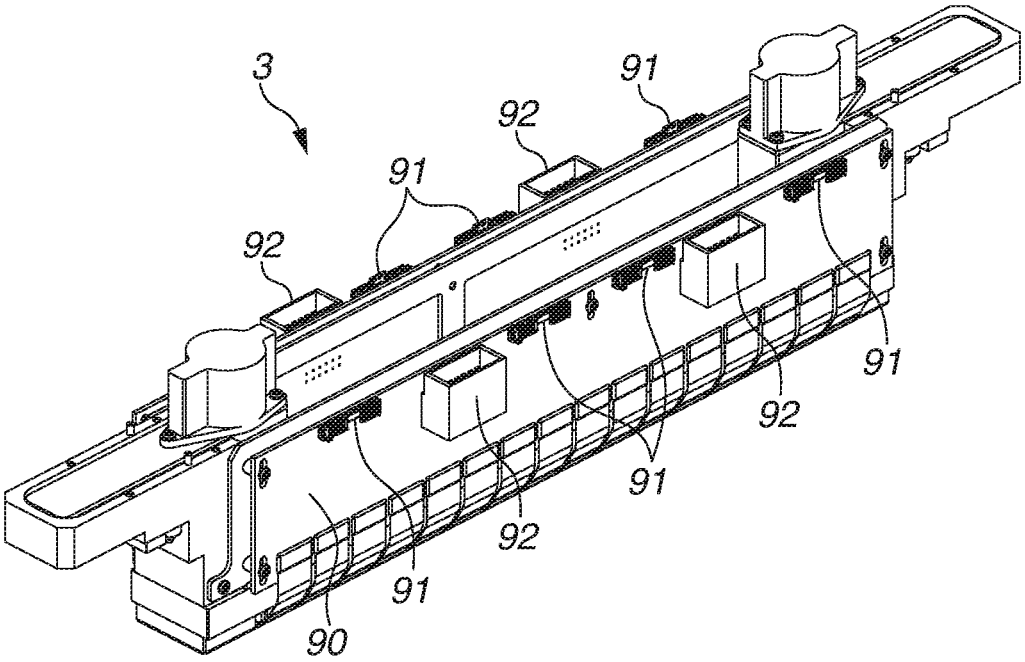

FIGS. 2A and 2B are perspective diagrams of one of the liquid discharge heads 3 to which the present disclose is applicable. The liquid discharge head 3 is a line-type liquid discharge head having 15 pieces of recording element substrates 10 arranged in a straight line (e.g., arranged in-line). Each of the recording element substrates 10 can discharge one of ink colors of C, M, Y, and K. The liquid discharge head 3 includes the recording element substrates 10, and signal input terminals 91 and power supply terminals 92. The input terminals 91 and the power supply terminals 92 are electrically connected to the recording element substrates 10 via flexible wiring substrates 40 and an electric wiring substrate 90. The signal input terminals 91 and the power supply terminals 92 are electrically connected to a control unit of the recording apparatus 1000. The signal input terminals 91 and the power supply terminals 92 are configured to supply discharge driving signals and power used for discharging ink, respectively, to the recording element substrates 10. The number of signal input terminals 91 and power supply terminals 92 can be less than the number of the recording element substrates 10 by consolidating wiring using electric circuits included in the electric wiring substrate 90. This configuration reduces a number of electric connection portions to be used for attaching the liquid discharge head 3 to or detaching the liquid discharge head 3 for replacement from the recording apparatus 1000. On each end of the liquid discharge head 3, a liquid connection portion 111 is arranged to be connected to a liquid supply system provided on a main body of the recording apparatus 1000. Thus, ink is supplied to each of the liquid discharge heads 3 from the supply system of the main body of the recording apparatus 1000, and is then collected to the supply system thereof through the liquid discharge head 3. As described above, ink can be circulated through a path of the recording apparatus 1000 and a path of the liquid discharge head 3.

<Recording Element Substrate>

Figure 3:
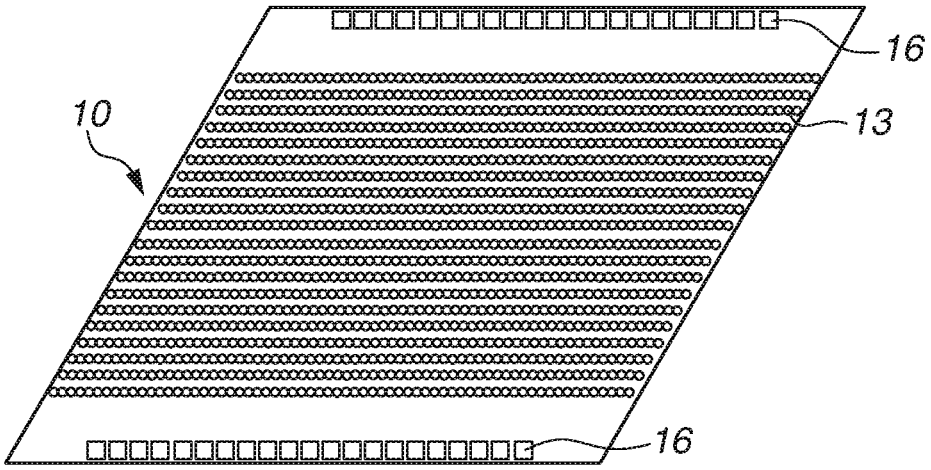
FIG. 3 is a plan view of a recording element substrate.
Figure 4:
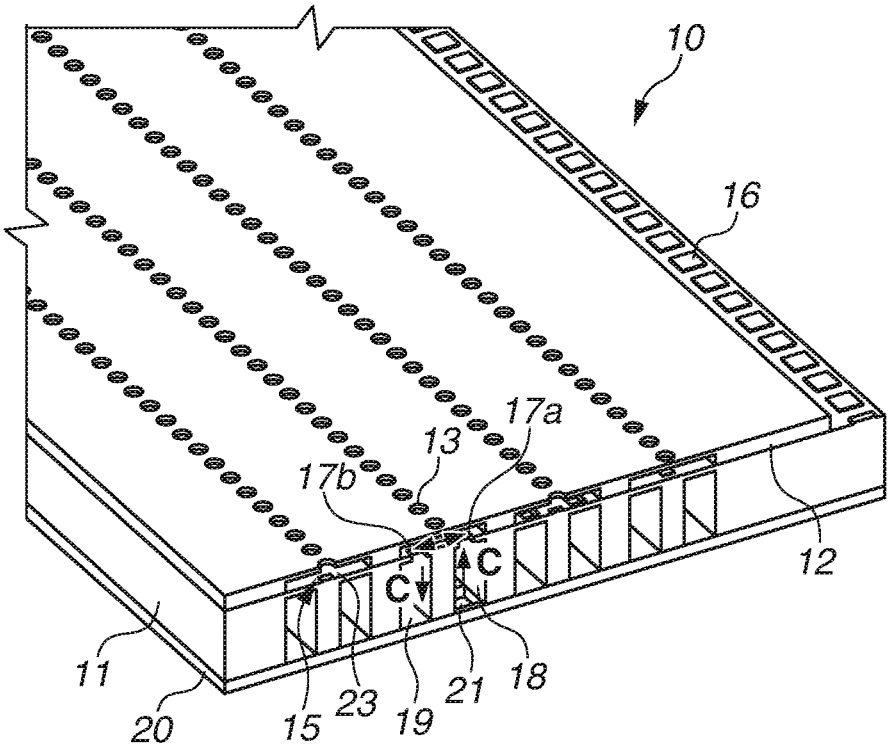
FIG. 4 is a perspective view illustrating a cross-sectional face of the recording element substrate and a cover member.

A configuration of the recording element substrate 10 according to the present exemplary embodiment will be described. FIG. 3 illustrates a plan view of one face of the recording element substrate 10 on which a discharge port 13 is formed. FIG. 4 illustrates a perspective view of a part of the recording element substrate 10.

The recording element substrate 10 is configured of a substrate 11, which is made of a silicon (Si) material, and a discharge port forming member 12, which is made of a photosensitive resin material. The substrate 11 and the discharge port forming member 12 are laminated one on top of another. On a back face of the substrate 11, a cover plate 20 (cover member) is attached. On one face of the substrate 11, a recording element 15, a supply port 17*a*, and a collection port 17*b* are formed. On the back face side of the substrate 11, a liquid supply path 18 and a liquid collection path 19 extending along a discharge port row are formed in a groove shape. The liquid supply path 18 and the liquid collection path 19 respectively communicate with the discharge ports 13 via the supply port 17*a* and the collection port 17*b*. On the cover plate 20, a plurality of openings 21 is arranged communicating with the liquid supply path 18 and the liquid collection path 19.

At a position corresponding to each of the discharge ports 13, a recording element 15 is arranged. The recording element 15 is a heat generating resistor for bubbling up liquid through thermal energy. Further, a pressure chamber 23 (flow path) which internally includes the recording element 15 is formed by a partition wall 22 (see FIG. 5A). Each of the recording elements 15 is electrically connected to a terminal 16 through electric wiring (not illustrated) provided on the recording element substrate 10. The recording elements 15 generate heat to boil liquid based on pulse signals received from a control circuit of the recording apparatus 1000 via the electric wiring substrate 90 and the flexible wiring substrate 40. Liquid is discharged from the discharge port 13 by bubbling power of the boiling liquid.

Next, flow of liquid inside the recording element substrate 10 will be described. The liquid supply path 18 and the liquid collection path 19 formed by the substrate 11 and the cover plate 20 are respectively connected to a common supply flow path and a common collection flow path formed inside a supporting member for supporting the recording element substrate 10. Between the liquid supply path 18 and the liquid collection path 19, a pressure difference occurs. When liquid is being discharged from the discharge ports 13 of the liquid discharge head 3, at the discharge ports 13 from which liquid is not discharged, liquid within the liquid supply path 18 flows into the liquid collection path 19 via the supply port 17*a*, the pressure chamber 23, and the collection port 17*b* because of the pressure difference. The flow of liquid is illustrated by arrows C in FIG. 4. With this flow of liquid, at the discharge port 13 or the pressure chamber 23 where recording is being stopped, substances such as thickened ink, bubbles, and foreign objects caused by evaporation occurring in the discharge port 13 can be collected to the liquid collection path 19. Further, ink within the discharge port 13 or the pressure chamber 23 can be prevented from being thickened. The liquid collected to the liquid collection path 19 is collected to the common collection path inside the supporting member via the opening 21 of the cover plate 20, and is eventually collected to the supply path of the recording apparatus 1000.

Figure 5A:
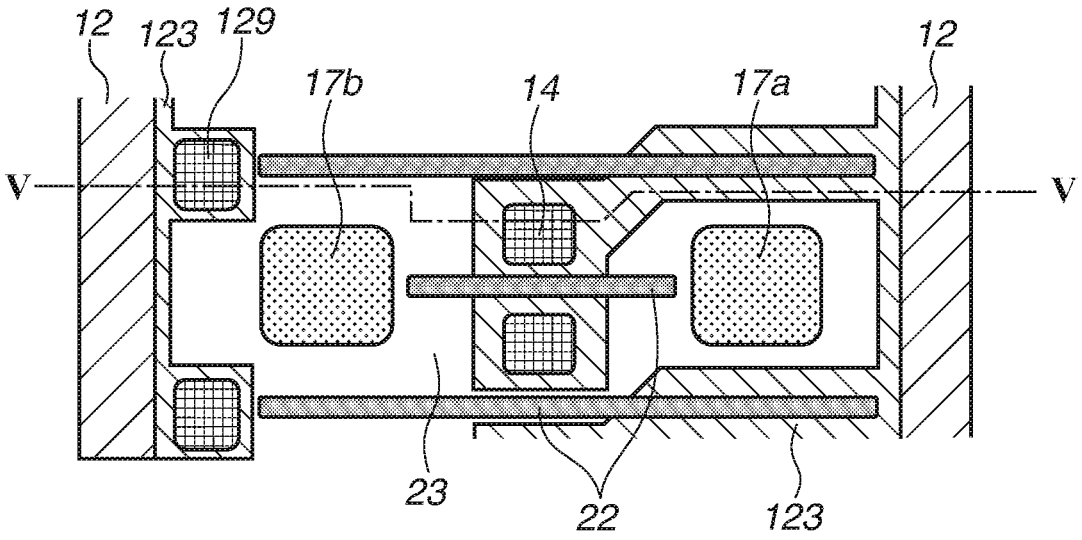
FIGS. 5A and 5B are diagrams partially illustrating the recording element substrate.
Figure 5B:
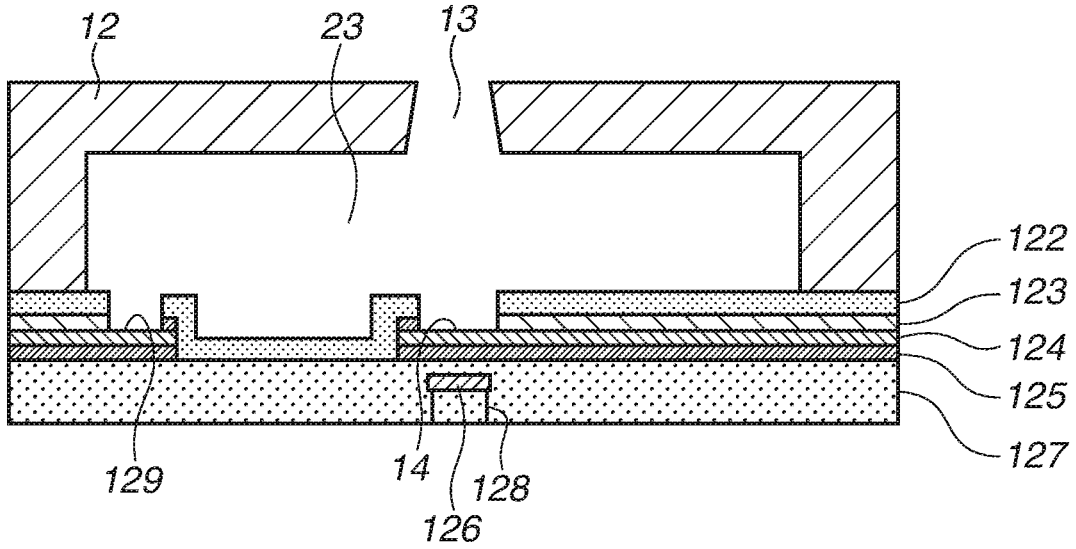

FIG. 5A is a schematic diagram illustrating a partial plan view of the enlarged recording element substrate 10. FIG. 5B is a schematic cross-sectional diagram taken along a line V-V in FIG. 5A. In FIG. 5A, in order to illustrate positions of the below-described first electrode 14 and the second electrode 129 formed on the substrate 11, the discharge port forming member 12 is partially omitted.

A laminated structure of the recording element substrate 10 will be described with reference to FIG. 5B. The recording element substrate 10 is configured of a plurality of layers laminated on a base substrate made of a silicon material. In the present exemplary embodiment, a thermal accumulation layer formed of a thermal oxide film, a silicon monoxide (SiO) film, or a silicon nitride (SiN) film is arranged on a silicon base substrate. On the upper side of the thermal accumulation layer, the heat generating resistor 126 is arranged, and an electrode wiring layer (not illustrated) is connected to the heat generating resistor 126 via a tungsten plug 128. The electrode wiring layer serving as wiring is made of a metallic material, such as aluminum (Al), aluminum-silicon (Al—Si), or aluminum-copper (Al—Cu). On the heat generating resistor 126, an insulation protection layer 127 is arranged. The insulation protection layer 127 is arranged on the upper side (e.g., flow path side) thereof to cover the heat generating resistor 126. The insulation protection layer 127 is formed of a SiO film or a SiN film.

On the insulation protection layer 127, a protection layer is arranged. In the present exemplary embodiment, the protection layer is configured of a lower protection layer 125, an upper protection layer 124, and an adhesive protection layer 123 that are laminated on one on top of the other. The lower protection layer 125 is made of tantalum (Ta), the upper protection layer 124 is made of iridium (Ir), and the adhesive protection layer 123 is made of tantalum. The protection layers made of the above-described materials have electrical conductivity. The adhesive protection layer 123 is removed from a portion on the upper side of the heat generating resistor 126, so that the upper protection layer 124 is exposed therefrom. Accordingly, the lower protection layer 125 and the upper protection layer 124 serve as the layers that protect a surface of the heat generating resistor 126 from chemical or physical impact caused by heat generated from the heat generating resistor 126. The upper protection layer 124 is arranged in such a state that a surface thereof is in contact with liquid inside the flow path 23. Because of instantaneous rise in temperature of the liquid on the surface of the upper protection layer 124, bubbles are generated and disappear therefrom to cause cavitation to occur. For this reason, in the present exemplary embodiment, the upper protection layer 124 is made of iridium having high corrosion resistivity and high reliability.

On top of the adhesive protection layer 123, a protection layer 122 is arranged. The protection layer 122 provides liquid-resistant property and improved adhesiveness with respect to the discharge port forming member 12. In the present exemplary embodiment, the protection layer 122 is made of a material such as silicon carbide (SiC) or silicon carbide nitride (SiCN).

<Scorched Substance Cleaning Processing>

The liquid discharge apparatus according to the present exemplary embodiment includes a first electrode 14, and a second electrode 129. The first electrode 14 is arranged on the upper side of the heat generating resistor 126, and corresponds to a portion of the upper protection layer 124 that is exposed to the flow path 23. Voltage can be applied between the first electrode 14 and the second electrode 129 via the liquid. When liquid is discharged, a scorched substance is accumulated on the surface of the upper protection layer 124. In order to remove the scorched substance, voltage is applied such that the first electrode 14 and the second electrode 129 serve as an anode electrode and a cathode electrode, respectively. Thereby, electrochemical reaction occurs between these electrodes and the ink (liquid) in which an electrolyte solution is induced. Accordingly, a surface of the upper protection layer 124 on the upper side of the heat generating resistor 126, on which the scorched substance is accumulated, is eluted into the liquid, so that the scorched substance accumulated on the surface of the upper protection layer 124 is be removed. By periodically executing the scorched substance cleaning processing, durability of the liquid discharge head can be improved.

In order to execute the above-described cleaning processing, it is preferable that the upper protection layer 124 that constitutes the first electrode 14 be made of a material mainly consisting of metal that is eluted by the electrochemical reaction and that does not form an oxide film that disturbs elution when heated. It is preferable to use a platinum group material for such a material. Further, in order to reduce the production load, it is preferable that the second electrode 129 be also formed as a layer made of a material the same as that of the upper protection layer 124.

The first electrode 14 and the second electrode 129 are electrically connected to the terminal 16 via the adhesive protection layer 123 and the electrode wiring layer, and voltage can be applied to both of the electrodes 14 and 129 via the terminal 16.

As described above, when the scorched substance accumulated on the upper protection layer 124 is removed, particles such as pigment particles charged in a negative polarity contained in the liquid are adsorbed to the surface of the first electrode 14 because the first electrode 14 serves as an anode electrode. If the particles are adsorbed to the surface of the first electrode 14, liquid discharge may be unstable. Further, if the surface of the first electrode 14 is covered by the particles adsorbed thereto, removal of the scorched substance through the electrochemical reaction is disturbed thereby, so that the scorched substance will not be removed sufficiently. Therefore, the particles need to be prevented from being adsorbed to the surface of the first electrode 14 or need to be removed from the surface thereof.

For this purpose, voltage in a polarity opposite to a polarity of voltage applied for removing the scorched substance is applied to both the electrodes 14 and 129. In other words, voltage is applied to both the electrodes 14 and 129 via the liquid to cause the first electrode 14 to serve as a cathode electrode and the second electrode 129 to serve as an anode electrode. With this processing, the pigment particles charged in a negative polarity are repelled from the first electrode 14 serving as a cathode electrode and dispersed to the liquid. Accordingly, the particles are prevented from being adsorbed to the surface of the first electrode 14, and removed from the surface thereof. Further, voltage that causes the second electrode 129 to be eluted is preferably applied in order to make the particles charged in a negative polarity be sufficiently repelled from the first electrode 14.

When voltage is applied as described above, the particles charged in the negative polarity are adsorbed to the surface of the second electrode 129 serving as an anode electrode. When voltage is applied to the first electrode 14 and the second electrode 129 with inverted voltage polarities, the scorched substance is removed together with the surface of the first electrode 14 eluted. The particles adsorbed to the surface of the second electrode 129 are then removed, and particles are adsorbed to the surface of the first electrode 14 again.

In order to sufficiently remove the scorched substance accumulated on the surface of the first electrode 14, operation of inverting the polarity of voltage applied between the first electrode 14 and the second electrode 129 is preferably executed repeatedly in a single flow of cleaning processing.

In this specification document, the processing of applying voltage between the first electrode 14 and the second electrode 129 via liquid and making the first electrode 14 be eluted to the liquid is also referred to as "first elution processing". The processing of applying voltage between the first electrode 14 and the second electrode 129 via liquid and making the second electrode 129 be eluted to the liquid is also referred to as "second elution processing". In order to remove the scorched substance accumulated on the surface of the first electrode 14, the first elution processing and the second elution processing may be executed at least one time each in a single flow of cleaning processing. In order to sufficiently remove the scorched substance, as described in the present exemplary embodiment, the first elution processing and the second elution processing are preferably be executed alternately and repeatedly in a single flow of cleaning processing. The first elution processing and the second elution processing may be executed with an interval therebetween. However, in order to shorten the time taken to execute the cleaning processing, the first elution processing and the second elution processing are preferably be executed alternately and repeatedly without having the interval.

<Circuit Configuration>

Figure 6A:
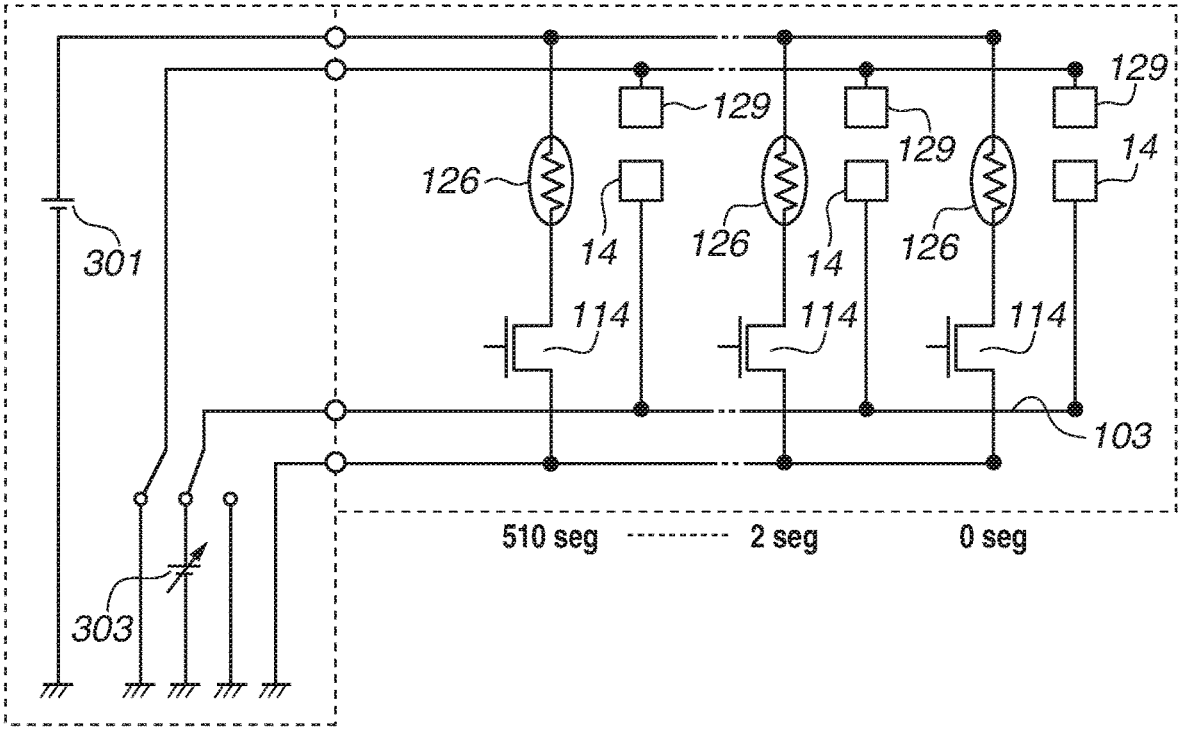
FIGS. 6A and 6B are circuit diagrams illustrating scorched substance cleaning processing.
Figure 6B:
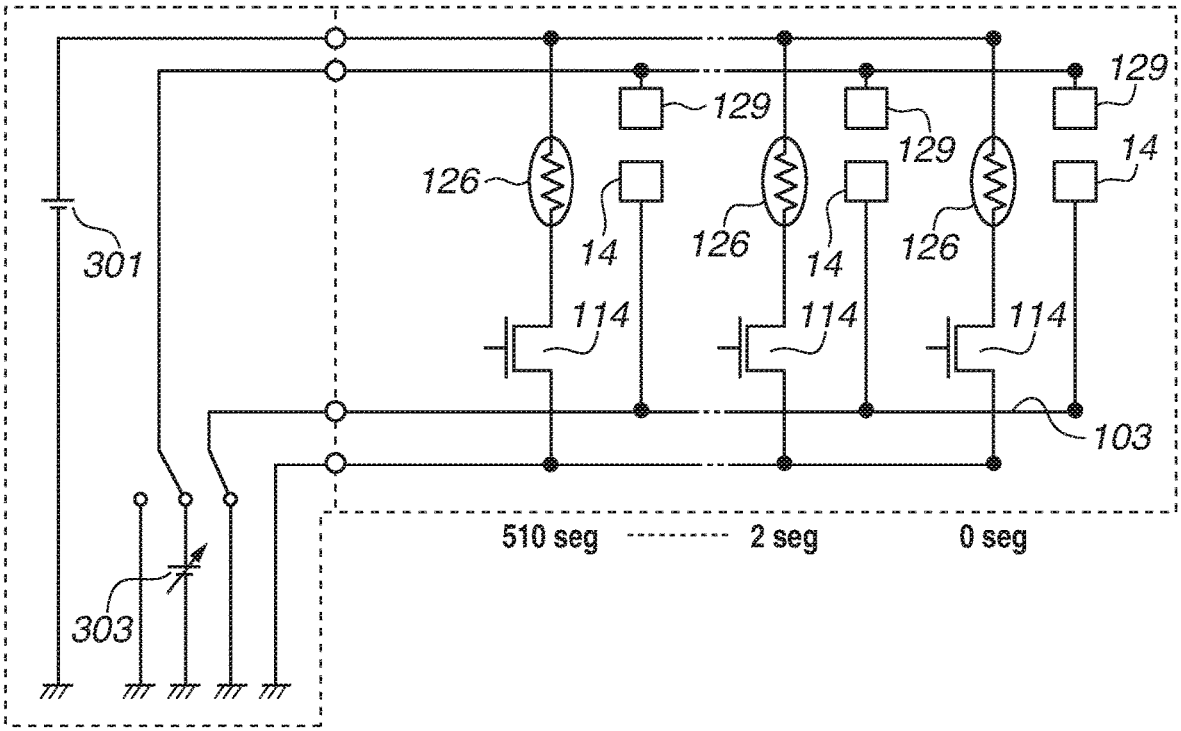

FIGS. 6A and 6B are examples of a circuit diagram of the liquid discharge head according to the present exemplary embodiment. A plurality of heat generating resistors 126 is connected to a power source 301 having a driving voltage of, for example, 20 V to 35 V. Each of the plurality of heat generating resistors 126 is connected to a switching transistor 114 ON/OFF states of the switching transistor 114 are switched by a selection circuit, so that driving of the corresponding heat generating resistor 126 is controlled. With this configuration, power is be supplied to the heat generating resistor 126 from the power source 301 at a predetermined timing, and thus liquid droplets can be discharged from the discharge port 13 at a predetermined timing.

The insulation protection layer 127 (see FIG. 5B) functioning as an insulation layer is arranged between the above-described heat generating resistor 126 and the first electrode 14 (e.g., upper protection layer 124). Thus, the heat generating resistor 126 and the first electrode 14 are not connected electrically. The plurality of first electrodes 14 corresponding to one row of the heat generating resistors 126 is electrically connected to each other via a common wiring line 103.

FIGS. 6A and 6B illustrate connection states of the circuit when the above-described scorched substance cleaning processing is executed. In FIG. 6A, the second electrode 129 is set to 0 V (same potential as that of a ground (GND)). Then, the first electrode 14 is electrically connected to the power source 303 (voltage application unit), and positive potential of, for example, +3.5 V to +10 V is applied to the first electrode 14. With this configuration, the surface of the first electrode 14 is eluted to the liquid, and the scorched substance is removed therefrom (the first elution processing). Thereafter, the connection is switched to a state illustrated in FIG. 6B. Then, positive potential of +3.5 V to +10 V is applied to the second electrode 129, and the first electrode 14 is set to 0 V (same potential as that of the GND). With this configuration, particles charged in a negative polarity, containing in the liquid, are removed from the surface of the first electrode 14, and the surface of the second electrode 129 is eluted to the liquid (the second elution processing). For example, in a single flow of cleaning processing, the first elution processing and the second elution processing are alternately and repeatedly executed for a plurality of times (e.g., 15 times for each).

<Condition for Executing Scorched Substance Cleaning Processing>

Figure 7A:
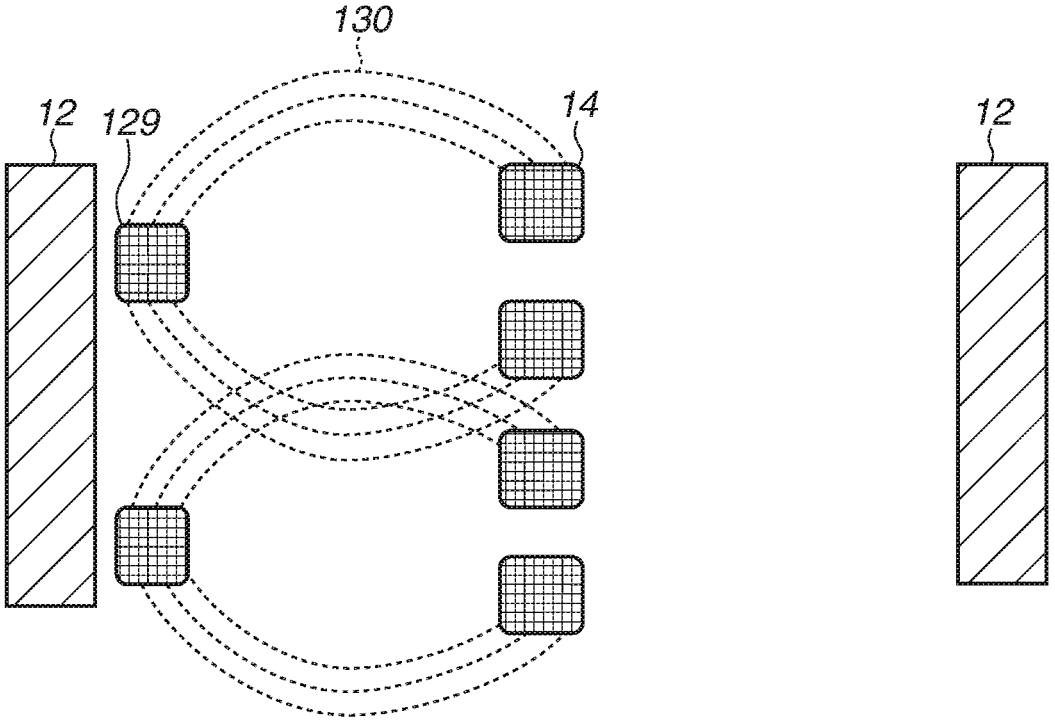
FIGS. 7A and 7B are schematic diagrams illustrating an electric field generated when the scorched substance cleaning processing is executed.
Figure 7B:
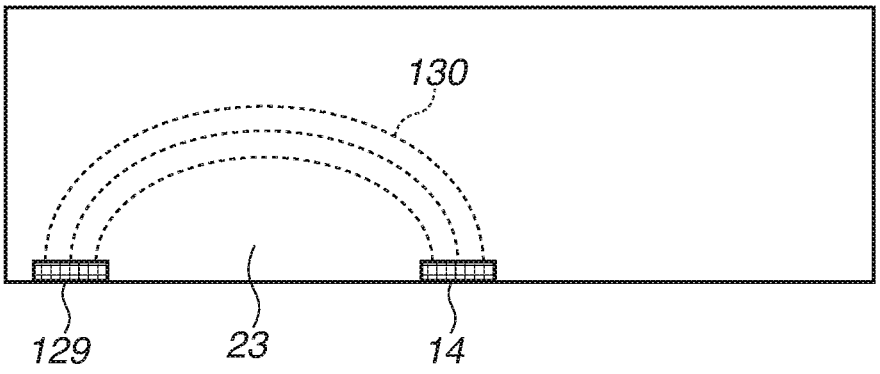

FIGS. 7A and 7B are schematic diagrams illustrating an electric field (line of electric force) 130 generated between the first electrode 14 and the second electrode 129 when the first elution processing and the second elution processing are executed. FIG. 7A is a schematic plan view, and FIG. 7B is a schematic cross-sectional view of the electric field 130. In the present exemplary embodiment, an area of the second electrode 129 functioning when the cleaning processing is executed is smaller than an area of the first electrode 14 functioning when the cleaning processing is executed. In other words, an area of a second face of the second electrode 129 exposed to the flow path 23 is smaller than an area of a first face of the first electrode 14 exposed to the flow path 23. More precisely, one second electrode 129 is positioned at a shortest distance from two adjacent first electrodes 14 in the flow path 23. In other words, the one second electrode 129 is arranged corresponding to the two first electrodes 14.

Then, the area of the second face of the one second electrode 129 is smaller than a total of the areas of the first faces of the two first electrodes 14.

In a case where the area of the second electrode 129 is smaller than the area of the first electrode 14 as described in the present exemplary embodiment, there arises following issues if the first elution processing and the second elution processing are executed under equal voltage application conditions (e.g., with an equal applied voltage value and an equal voltage application time). In other words, the current density of a surface of the second electrode 129 in the second elution processing is higher than the current density of a surface of the first electrode 14 in the first elution processing, and thus an elution amount per unit area of the second electrode 129 is greater than that of the first electrode 14. Accordingly, if the first elution processing and the second elution processing are executed under the equal voltage application conditions, a film thickness of the second electrode 129 is decreased faster than that of the first electrode 14. If any one of the electrodes 14 and 129 is eluted and consumed completely, the scorched substance cleaning processing cannot be executed any more.

In the present exemplary embodiment, it is preferable that a difference between the elution amounts of the first electrode 14 and the second electrode 129 be reduced by reducing a second power amount used for the second elution processing to be smaller than a first power amount used for the first elution processing. It is also preferable that the first electrode 14 and the second electrode 129 be eluted equally.

In a case where voltage is applied to a plurality of first electrodes 14 and a plurality of second electrodes 129 when the cleaning processing is executed, total areas of respective electrodes 14 and 129 are taken into consideration. As illustrated in FIG. 6A, in the present exemplary embodiment, the first electrodes 14 corresponding to one row of heat generating resistors 126 are electrically connected to each other. The second electrodes 129 for applying voltage to the first electrodes 14 are also electrically connected to each other. Thus, a total area of the first faces of the first electrodes 14 and a total area of the second faces of the second electrodes 129 are taken into consideration when the voltage application conditions are set with respect to the first elution processing and the second elution processing. The voltage application conditions can be set in a similar way when a plurality of rows of heat generating resistors 126 is arranged on the recording element substrate 10. In other words, the plurality of first electrodes 14 corresponding to the plurality of rows of heat generating resistors 126 is electrically connected to each other, and the plurality of second electrodes 129 corresponding to the plurality of rows of heat generating resistors 126 is electrically connected to each other. In this case, the voltage application conditions may be set by taking the total area of the first faces of the first electrodes 14 and the total area of the second faces of the second electrodes 129 into consideration.

The total area of the first faces of the first electrodes 14 is expressed as "$S_1$[$\mu m^2$]", the total area of the second faces of the second electrodes 129 is expressed as "$S_2$[$\mu m^2$]", the first power amount (application energy) used for the first elution processing is expressed as "$W_1$[J]", and the second power amount used for the second elution processing is expressed as "$W_2$[J]". Then, the scorched substance cleaning processing is executed under the energy application conditions that satisfy a relationship "$W_1/S_1 \approx W_2/S_2$". In this way, a decrease amount of the film thickness of the first electrode 14 and that of the second electrode 129 caused by the scorched substance processing becomes approximately equal to each other. Accordingly, the first electrode 14 and the second electrode 129 can be consumed efficiently and completely, and thus durability of the liquid discharge head can be improved.

The power amount W[J] used for the scorched substance cleaning processing is proportional to the square of the applied voltage [V], and is proportional to the application time T[s]. Accordingly, by changing these application conditions, a ratio between the first power amount used for the first elution processing and the second power amount used for the second elution processing can be a ratio based on a ratio between the area of the first face of the first electrode 14 and the area of the second face of the second electrode 129.

Figure 8A:
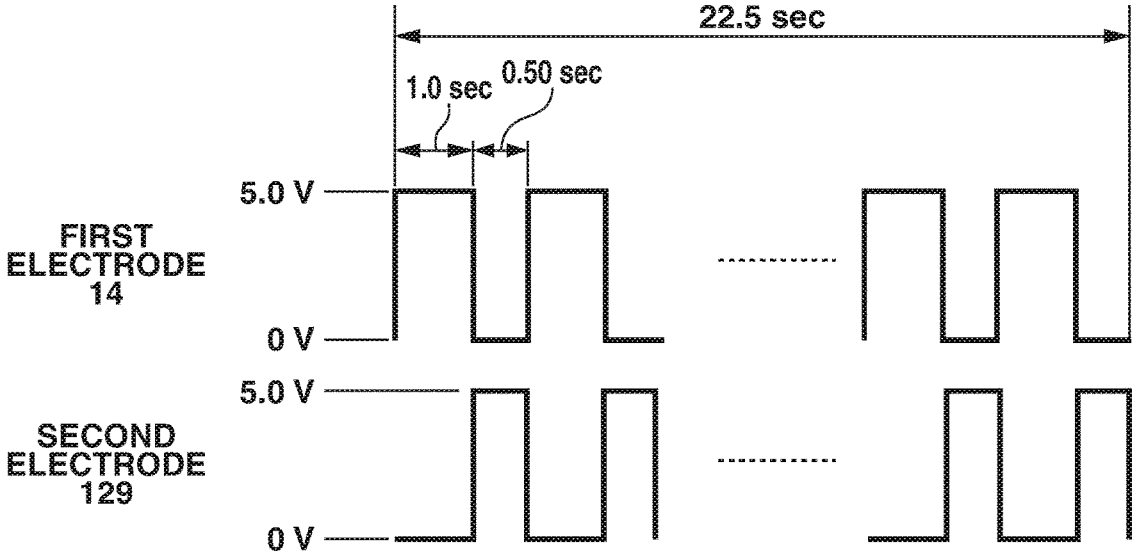
FIGS. 8A and 8B are diagrams illustrating examples of waveforms of voltage applied when the scorched substance cleaning processing is executed.
Figure 8B:
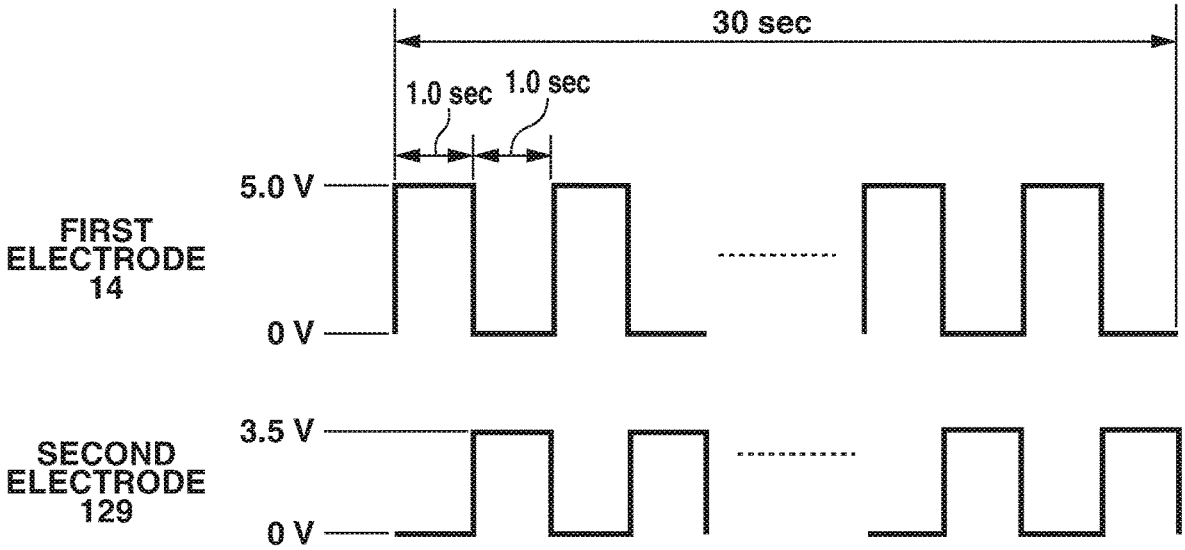

Hereinafter, a specific example of the voltage application condition in the first elution processing and the second elution processing will be described. FIGS. 8A and 8B are diagrams illustrating waveforms of voltage applied to the first electrode 14 and the second electrode 129.

In the present exemplary embodiment, an area of one first electrode 14 is 196 $\mu m^2$ (14 $\mu m \times 14$ $\mu m$). The number of first electrodes 14 corresponding to one row of heat generating resistors 126 is 512, and thus a total area of the first electrodes 14 is 100352 $\mu m^2$ (196 $\mu m^2 \times 512$ pcs). On the other hand, an area of one second electrode 129 is 196 $\mu m^2$ (14 $\mu m \times 14$ $\mu m$). The number of second electrodes 129 corresponding to one row of heat generating resistors 126 is 256, and thus a total area of the second electrodes 129 is 50175 $\mu m^2$ (196 $\mu m^2 \times 256$ pcs). In other words, since the ratio between the total area of the first electrodes 14 and the total area of the second electrodes 129 is 2:1, the voltage application condition is set such that the ratio between the first power amount used for the first elution processing and the second power amount used for the second elution processing also becomes 2:1.

In the example illustrated in FIG. 8A, the scorched substance cleaning processing is executed with different voltage application times. Specifically, in the first elution processing, a pulse of 5.0 V is applied to the first electrode 14 for 1.0 sec., and in the second elution processing, a pulse of 5.0 V is applied to the second electrode 129 for 0.50 sec. Voltage is applied alternately so that a timing of voltage applied to the first electrode 14 in the first elution processing and a timing of voltage applied to the second electrode 129 in the second elution processing do not overlap with each other. The first elution processing and the second elution processing are executed fifteen times for each.

In the example illustrated in FIG. 8B, the scorched substance cleaning processing is executed with different applied voltage values. Specifically, in the first elution processing, a pulse of 5.0 V is applied to the first electrode 14 for 1.0 sec., and in the second elution processing, a pulse of 3.5 V is applied to the second electrode 129 for 1.0 sec. Voltage is applied alternately so that a timing of voltage applied to the first electrode 14 in the first elution processing and a timing of voltage applied to the second electrode 129 in the second elution processing do not overlap with each other. The first elution processing and the second elution processing are executed fifteen times for each.

By executing the scorched substance cleaning processing as described above, the film thicknesses of the first electrode 14 and the second electrode 129 decrease equally, so that durability of the liquid discharge head can be improved.

In general, metallic materials eluted to liquid solution through the electrochemical reaction can be determined by using potential-pH (power of hydrogen) diagrams of various kinds of metal. In the present exemplary embodiment, a material that is not eluted at a pH value of ink and is eluted when it is applied voltage to serve as an anode electrode is used as a material of the upper protection layer 124.

It is also preferable that the upper protection layer 124 that is in contact with liquid be made of iridium. By using iridium to form the upper protection layer 124, the first electrode 14 that covers the heat generating resistor 126 can be prevented from being oxidized when liquid is being discharged, so that the first electrode 14 can stably function as a cathode electrode. In addition, a laminate structure is not always necessary for the second electrode 129. However, in order to reduce a production load, such as film formation or etching, it is preferable that the second electrode 129 have a laminate structure the same as the laminate structure of the protection film that covers the heat generating resistor 126.

By using the liquid discharge apparatus according to the present exemplary embodiment, the scorched substance processing can be executed without adsorption of pigment particles. Therefore, it is possible to recover deteriorated printing quality. With this configuration, a high-quality liquid discharge head having excellent durability and a recording apparatus which are capable of maintaining initial printing quality can be provided.

In the present exemplary embodiment, in addition to improving the durability of the liquid discharge head, a total area of the second electrode 129 is reduced to be smaller than a total area of the first electrode 14. Therefore, the recording element substrate 10 can be miniaturized.

Figure 9A:
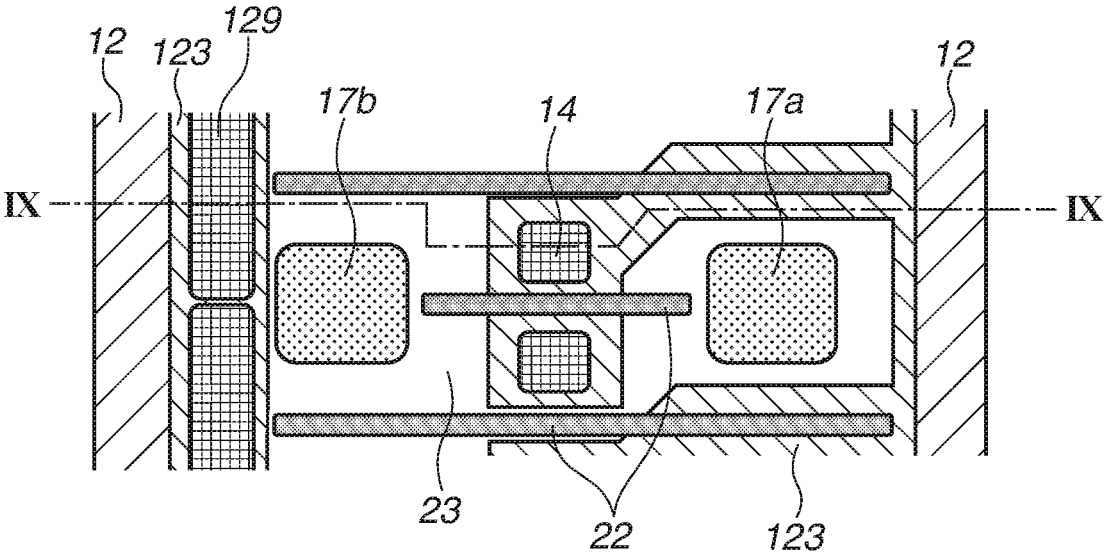
FIGS. 9A and 9B are diagrams partially illustrating a recording element substrate.
Figure 9B:
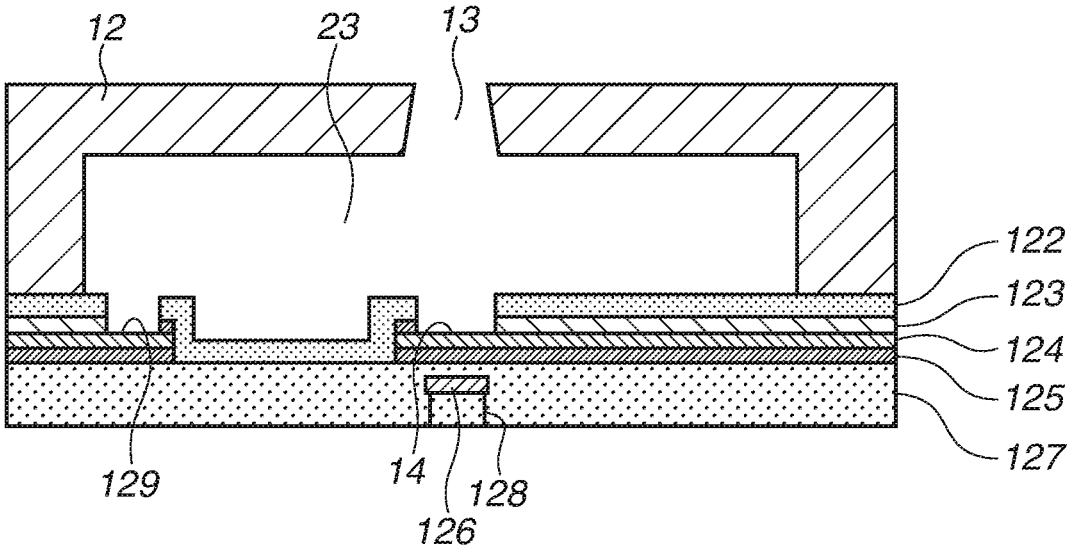

Next, a cleaning method of a liquid discharge head according to a second exemplary embodiment will be described. FIG. 9A is a schematic diagram illustrating a plan view of the enlarged recording element substrate 10 of the present exemplary embodiment. FIG. 9B is a schematic cross-sectional diagram taken along a line IX-IX marked in FIG. 9A. In FIG. 9A, in order to illustrate the positions of the first electrode 14 and the second electrode 129 formed on the substrate 11, the discharge port forming member 12 is omitted partially. In the following exemplary embodiment, a portion different from the above-described exemplary embodiment will be mainly described, and descriptions of a portion similar thereto will be omitted.

Figure 10A:
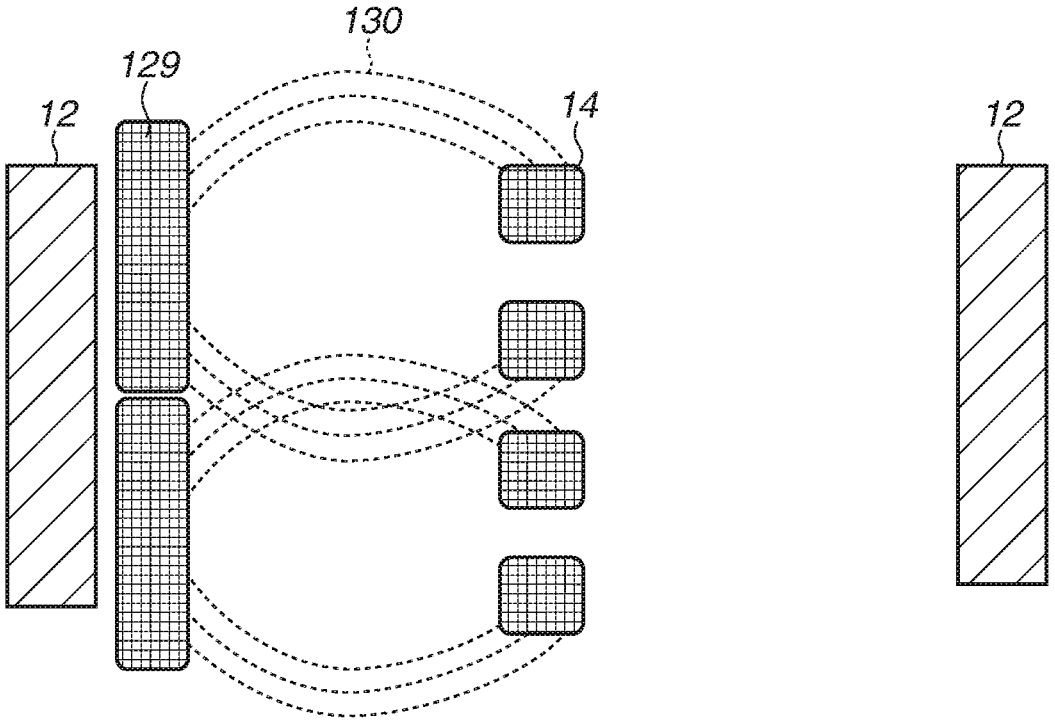
FIGS. 10A and 10B are schematic diagrams illustrating an electric field generated when the scorched substance cleaning processing is executed.
Figure 10B:
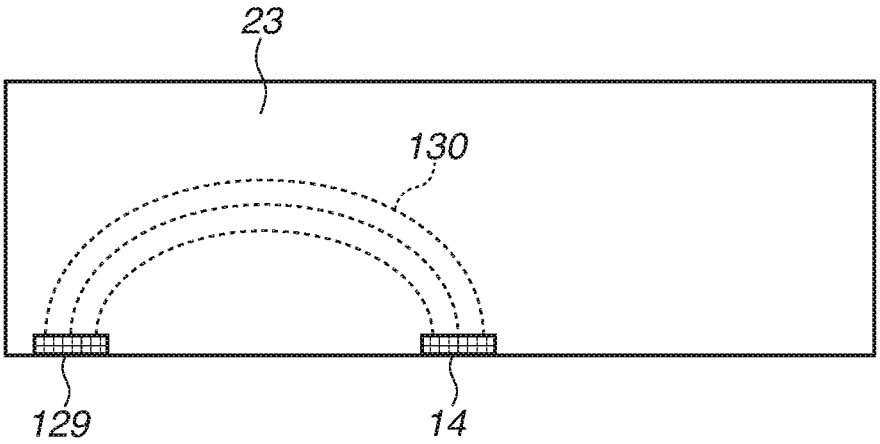

As illustrated in FIGS. 9A and 9B, an area (total area) of the first electrodes 14 is smaller than an area (total area) of the second electrodes 129 corresponding thereto. FIGS. 10A and 10B are schematic diagrams illustrating the electric field 130 generated between the first electrodes 14 and the second electrodes 129 when the first elution processing and the second elution processing are executed. FIG. 10A is a schematic plan view, and FIG. 10B is a schematic cross-sectional view of the electric field 130.

In the present exemplary embodiment, if the first elution processing and the second elution processing are executed under equal voltage application conditions, a current density of the first electrode 14 will be higher than a current density of the second electrode 129. Accordingly, an elution amount per unit area of the first electrode 14 caused by the electrochemical reaction is greater than that of the second electrode 129, so that the film thickness of the first electrode 14 is decreased faster than the film thickness of the second electrode 129. If any one of the electrodes 14 and 129 is eluted and consumed completely, the scorched substance cleaning processing cannot be executed any more.

In the present exemplary embodiment, it is preferable that a difference between elution amounts of the first electrode 14 and the second electrode 129 be reduced by increasing the second power amount used in the second elution processing to be greater than the first power amount used in the first elution processing. It is also preferable that the first electrode 14 and the second electrode 129 be eluted equally.

Figure 11A:
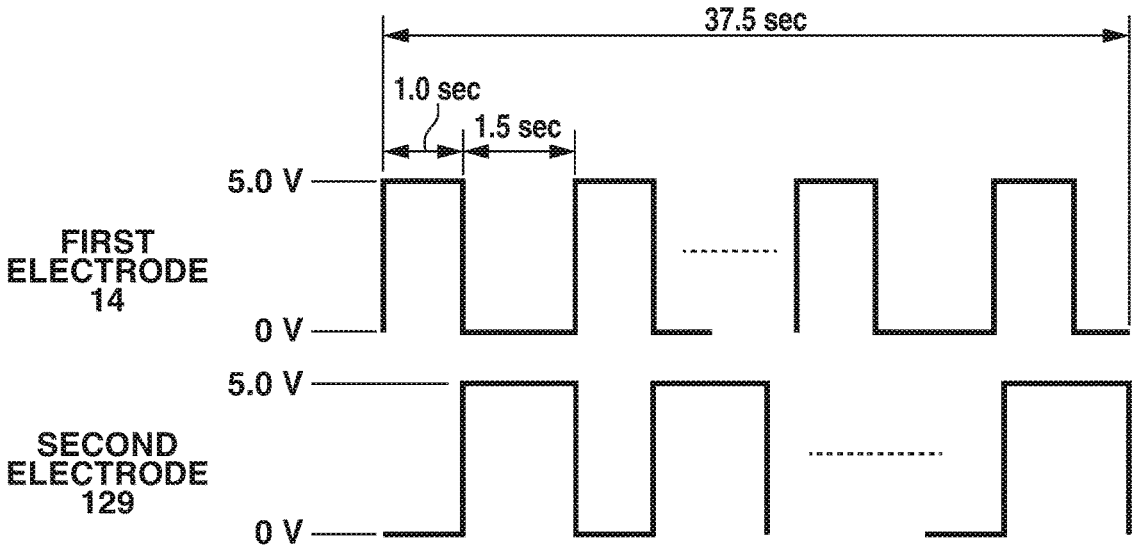
FIGS. 11A and 11B are diagrams illustrating examples of waveforms of voltage applied when the scorched substance cleaning processing is executed.
Figure 11B:
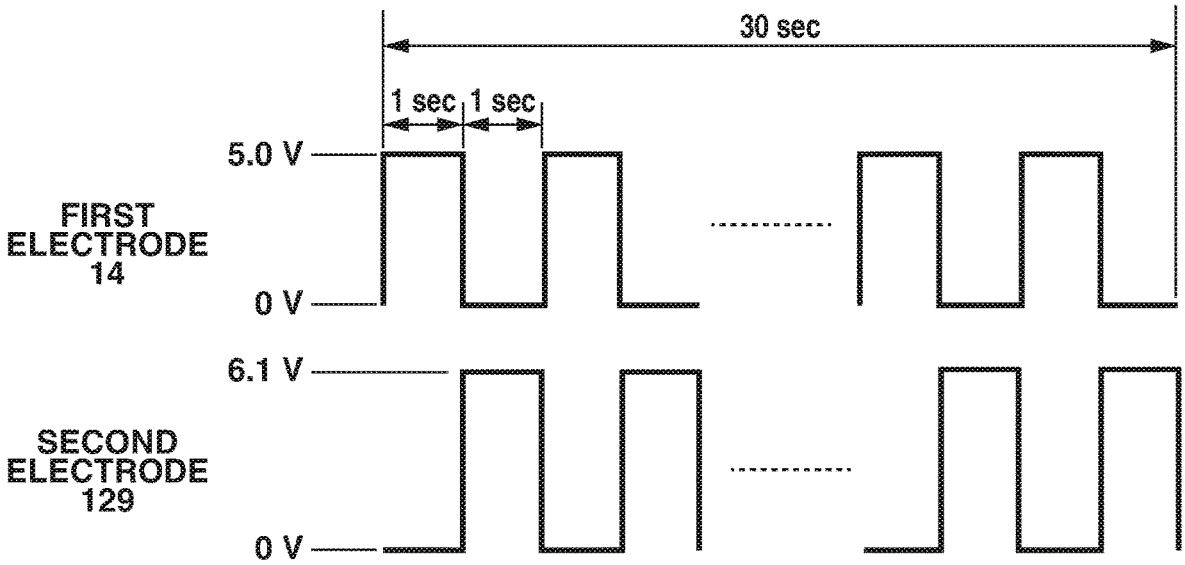

Hereinafter, a specific example of the voltage application condition in the first elution processing and the second elution processing will be described. FIGS. 11A and 11B are diagrams illustrating waveforms of voltage applied to the first electrode 14 and the second electrode 129.

In the present exemplary embodiment, the total area of the first electrode 14 is 100352 $\mu m^2$ (196 $\mu m^2 \times 512$ pcs), the same as the total area thereof in the above-described exemplary embodiment. On the other hand, an area of one second electrode 129 is 593 $\mu m^2$ (14 $\mu m \times 42.3$ $\mu m$). The number of second electrodes 129 corresponding to one row of heat generating resistors 126 is 256, and thus a total area of the second electrodes 129 is 151721 $\mu m^2$ (593 $\mu m^2 \times 256$ pcs). In other words, since the ratio between the total area of the first electrodes 14 and the total area of the second electrodes 129 is 2:3, the voltage application condition is set such that the ratio between the first power amount used for the first elution processing and the second power amount used for the second elution processing also becomes 2:3.

In the example illustrated in FIG. 11A, the scorched substance cleaning processing is executed with different voltage application time spans. Specifically, in the first elution processing, a pulse of 5.0 V is applied to the first electrode 14 for 1.0 sec., and in the second elution processing, a pulse of 5.0 V is applied to the second electrode 129 for 1.5 sec. Voltage is applied alternately so that a timing of voltage applied to the first electrode 14 in the first elution processing and a timing of voltage applied to the second electrode 129 in the second elution processing do not overlap with each other. The first elution processing and the second elution processing are executed fifteen times for each.

In the example illustrated in FIG. 11B, the scorched substance cleaning processing is executed with different applied voltage values. Specifically, in the first elution processing, a pulse of 5.0 V is applied to the first electrode 14 for 1.0 sec., and in the second elution processing, a pulse of 6.1 V is applied to the second electrode 129 for 1.0 sec. Voltage is applied alternately so that a timing of voltage applied to the first electrode 14 in the first elution processing and a timing of voltage applied to the second electrode 129 in the second elution processing do not overlap with each other. The first elution processing and the second elution processing are executed fifteen times for each.

By executing the scorched substance cleaning processing as described above, the film thicknesses of the first electrode 14 and the second electrode 129 are decreased equally, so that durability of the liquid discharge head can be improved.

Figure 12A:
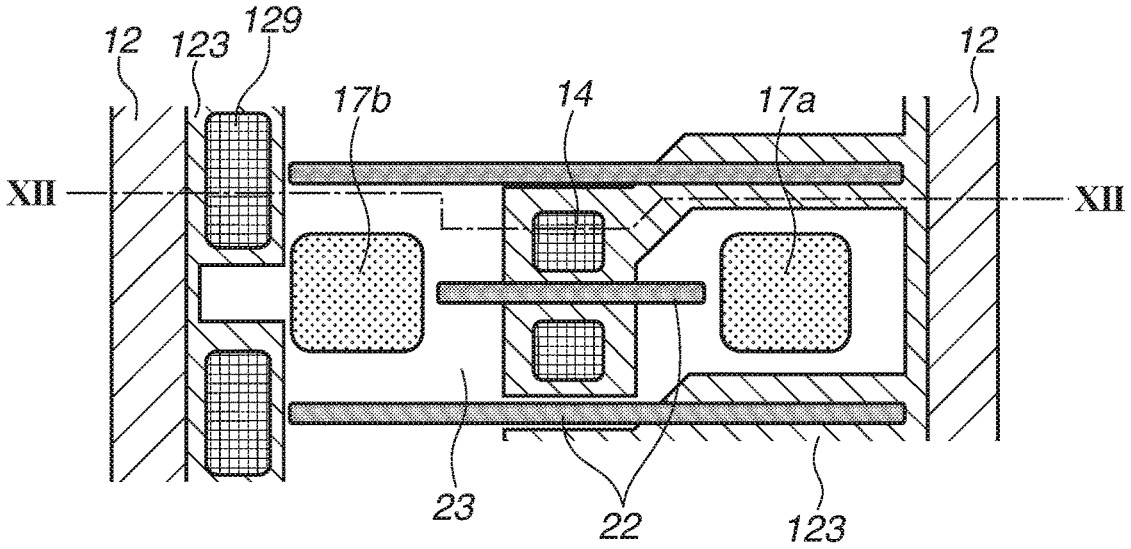
FIGS. 12A and 12B are diagrams partially illustrating a recording element substrate.
Figure 12B:
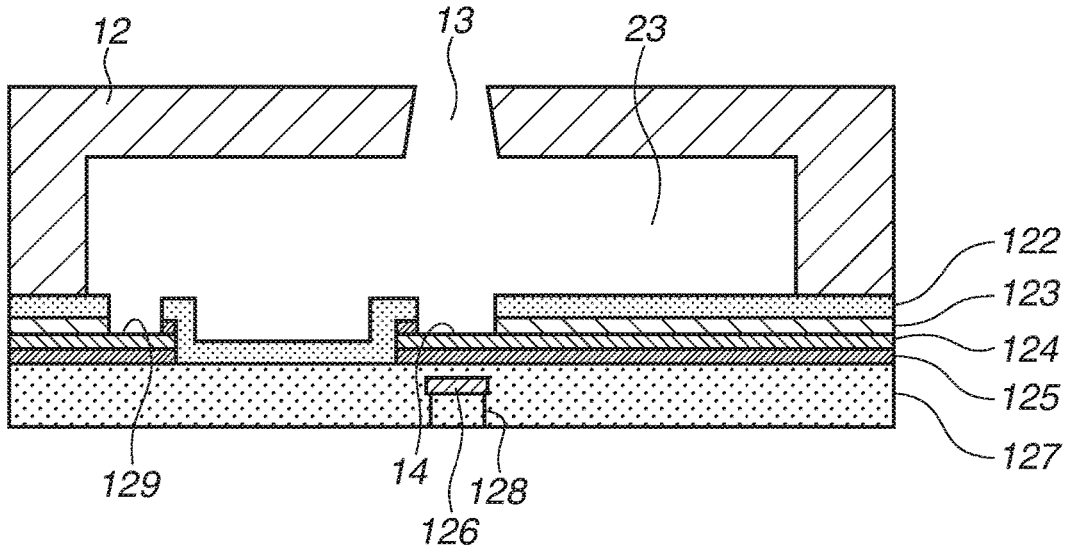

Next, a cleaning method of a liquid discharge head according to a third exemplary embodiment will be described. FIG. 12A is a schematic diagram illustrating a plan view of the enlarged recording element substrate 10 of the present exemplary embodiment. FIG. 12B is a schematic cross-sectional diagram taken along a line XII-XII marked in FIG. 12A. In FIG. 12A, in order to illustrate the positions of the first electrode 14 and the second electrode 129 formed on the substrate 11, the discharge port forming member 12 is omitted partially. In the following exemplary embodiment, a portion different from the above-described exemplary embodiments will be mainly described, and descriptions of a portion similar thereto will be omitted.

Figure 13A:
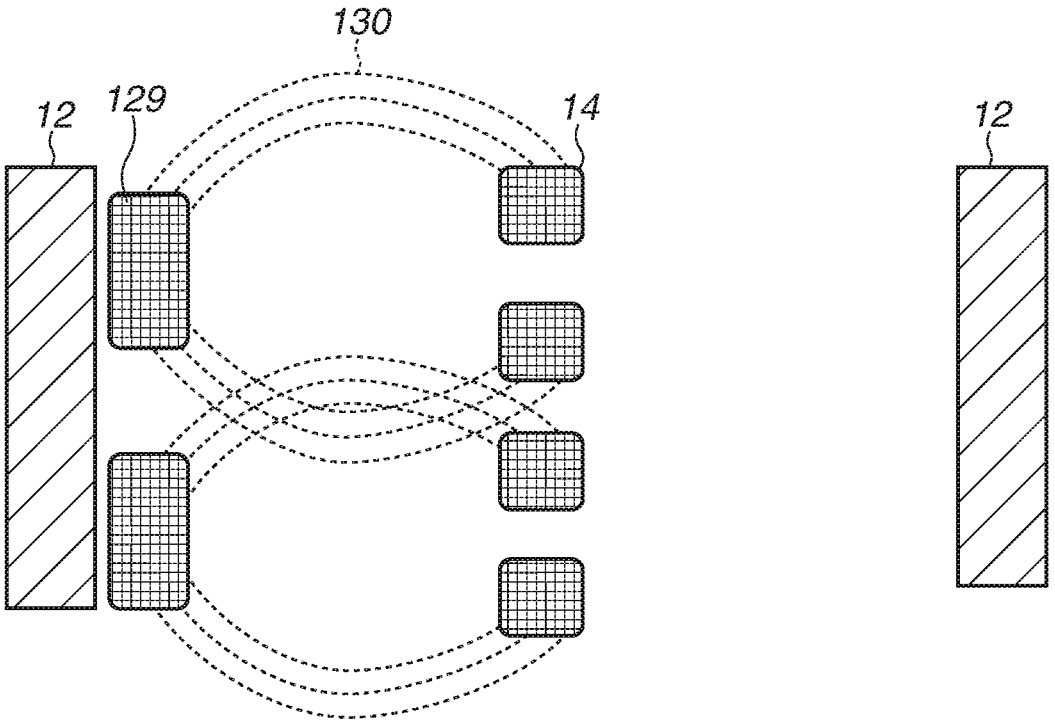
FIGS. 13A and 13B are schematic diagrams illustrating an electric field generated when the scorched substance cleaning processing is executed.
Figure 13B:
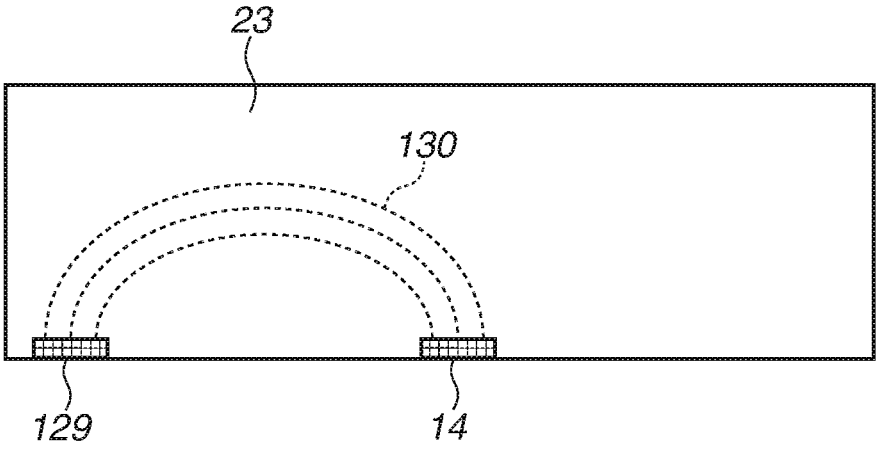

As illustrated in FIGS. 12A and 12B, an area (total area) of the first electrode 14 and an area (total area) of the corresponding second electrode 129 are approximately equal to each other. FIGS. 13A and 13B are schematic diagrams illustrating the electric field 130 generated between the first electrode 14 and the second electrode 129 when the first elution processing and the second elution processing are executed. FIG. 13A illustrates a schematic plan view, and FIG. 13B illustrates a schematic cross-sectional view of the electric field 130.

In a case where the total area of the first electrode 14 and the total area of the second electrode 129 are approximately equal to each other, the current density of the surface of the first electrode 14 and the current density of the surface of the second electrode 129 become equal by executing the first elution processing and the second elution processing under the approximately equal voltage application conditions. With this configuration, an elution amount per unit area becomes equal at both electrodes, so that the film thicknesses of the first electrode 14 and the second electrode 129 are decreased by the same amount. Accordingly, in the present exemplary embodiment, it is preferable that a difference between the elution amounts of the first electrode 14 and the second electrode 129 be reduced by making the first power amount used for the first elution processing and the second power amount used for the second elution processing be approximately equal. It is more preferable that the first electrode 14 and the second electrode 129 be eluted equally.

Figure 14:
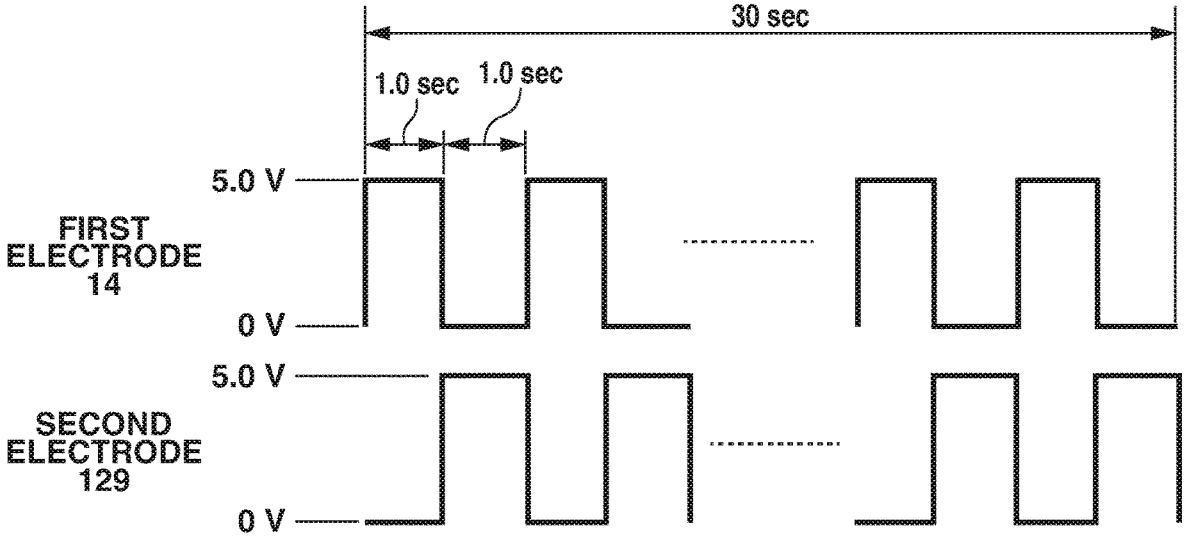
FIG. 14 is a diagram illustrating an example of waveforms of voltage applied when the scorched substance cleaning processing is executed.

Hereinafter, a specific example of the voltage application condition in the first elution processing and the second elution processing will be described. FIG. 14 is a diagram illustrating waveforms of voltage applied to the first electrode 14 and the second electrode 129.

In the present exemplary embodiment, the total area of the first electrode 14 is 100352 $\mu m^2$ (196 $\mu m^2 \times 512$ pcs), the same as the total area thereof in the above-described exemplary embodiment. On the other hand, an area of one second electrode 129 is 392 $\mu m^2$ (14 $\mu m \times 28$ $\mu m$). The number of second electrodes 129 corresponding to one row of heat generating resistors 126 is 256, and thus the total area of the second electrodes 129 is 100352 $\mu m^2$ (392 $\mu m^2 \times 256$ pcs). In other words, since the ratio between the total area of the first electrodes 14 and the total area of the second electrodes 129 is 1:1, the voltage application condition is set such that the ratio between the first power amount used for the first elution processing and the second power amount used for the second elution processing also becomes 1:1.

In the example illustrated in FIG. 14, specifically, a pulse of 5.0 V is applied to the first electrode 14 for 1.0 sec. in the first elution processing, and a pulse of 5.0 V is applied to the second electrode 129 for 1.0 sec. in the second elution processing. Voltage is applied alternately so that a timing of voltage applied to the first electrode 14 in the first elution processing and a timing of voltage applied to the second electrode 129 in the second elution processing do not overlap with each other. The first elution processing and the second elution processing are executed fifteen times for each.

By executing the scorched substance cleaning processing as described above, the film thicknesses of the first electrode 14 and the second electrode 129 are decreased equally, so that durability of the liquid discharge head can be improved.

Figure 15A:
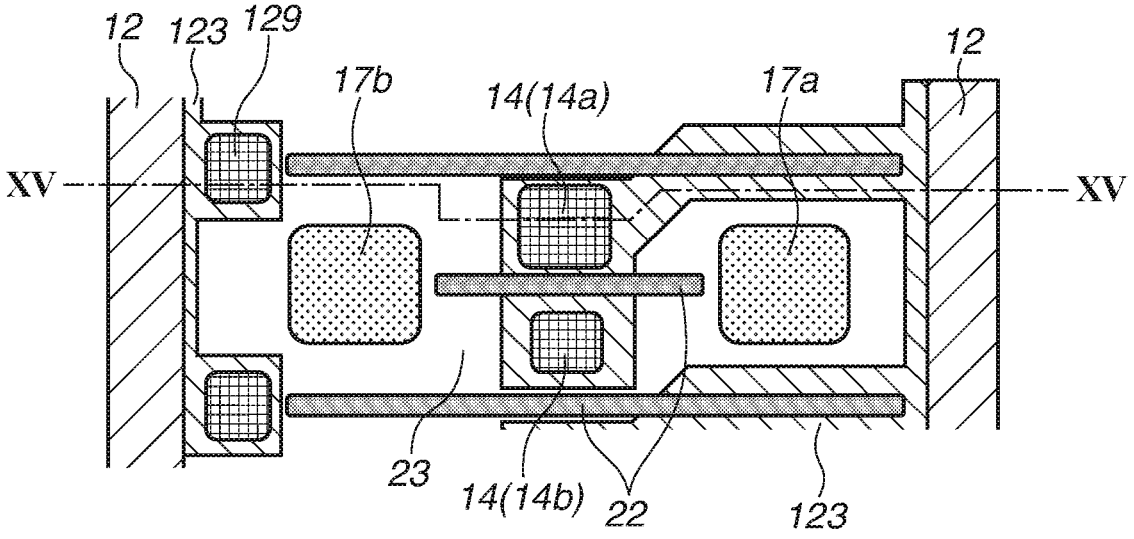
FIGS. 15A and 15B are diagrams partially illustrating a recording element substrate.
Figure 15B:
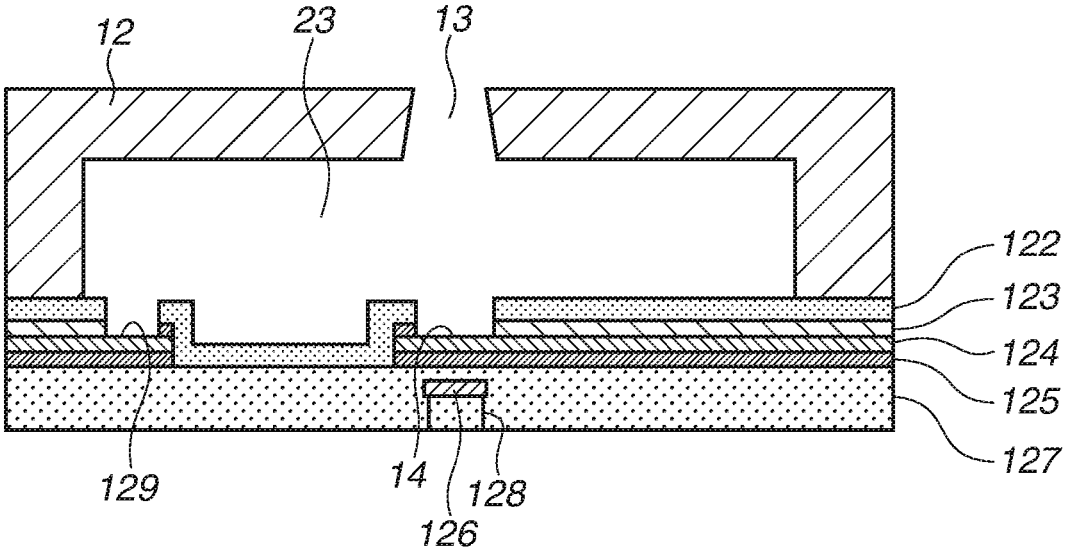

A cleaning method of a liquid discharge head according to a fourth exemplary embodiment will be described. FIG. 15A is a schematic diagram illustrating a plan view of the enlarged recording element substrate 10 of the present exemplary embodiment. FIG. 15B is a schematic cross-sectional diagram taken along a line XV-XV marked in FIG. 15A. In FIG. 15A, in order to illustrate the positions of the first electrode 14 and the second electrode 129 formed on the substrate 11, the discharge port forming member 12 is omitted partially. In the following exemplary embodiment, a portion different from the above-described exemplary embodiments will be mainly described, and descriptions of a portion similar thereto will be omitted.

Figure 16A:
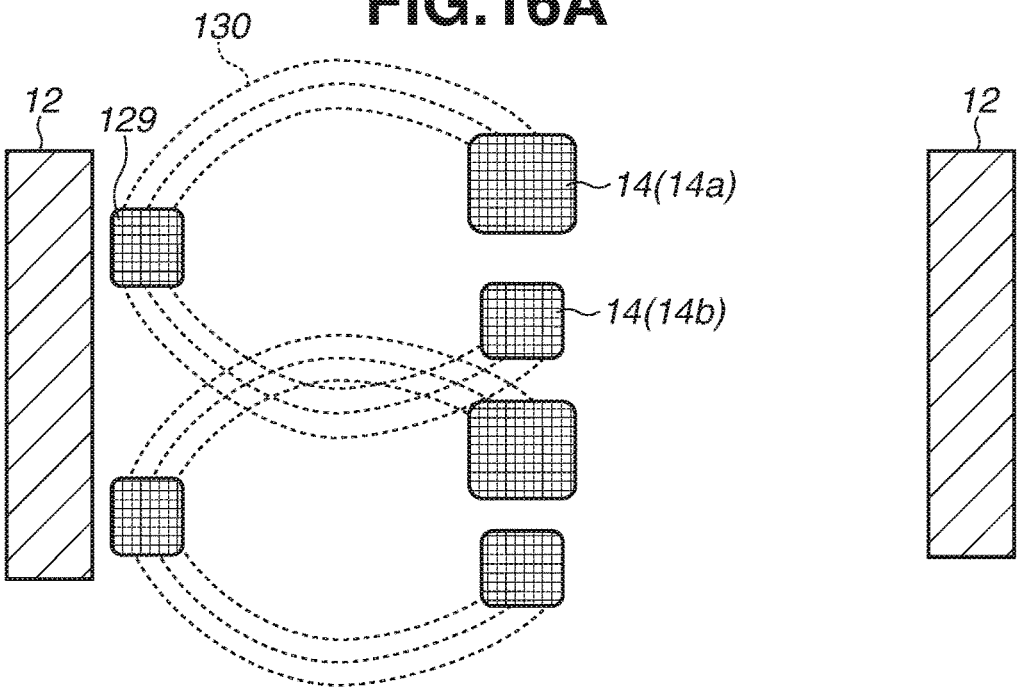
FIGS. 16A, 16B, and 16C are schematic diagrams illustrating an electric field generated when the scorched substance cleaning processing is executed.
Figure 16B:
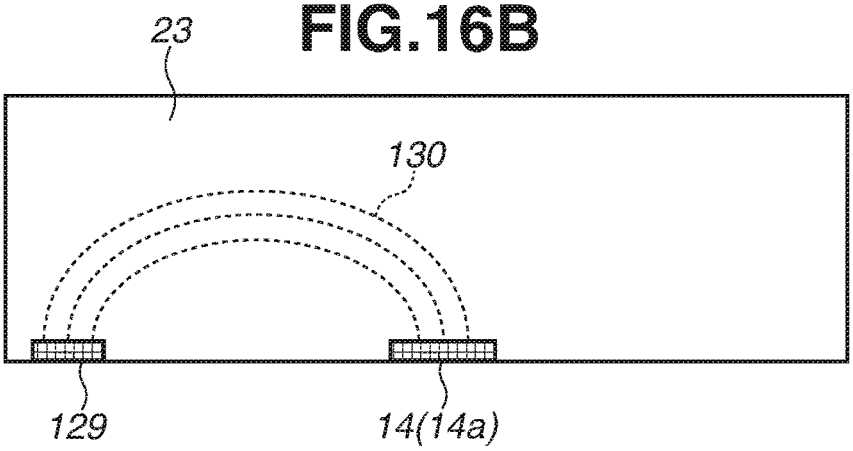
Figure 16C:
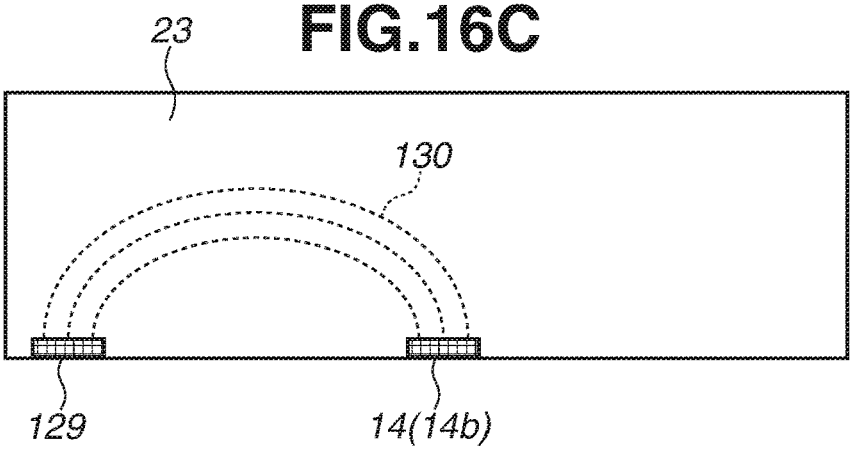

In a case where areas of the heat generating resistors 126 are in different sizes, areas of the first electrodes 14 that cover the heat generating resistors 126 may also in different sizes. The present exemplary embodiment will be described with respect to the case where the areas of the first electrodes 14 are in different sizes. As illustrated in FIG. 15A, the first electrode 14*a* having a large area and the first electrode 14*b* having a small area are arranged in a same row of the heat generating resistors 126. A total area of the first electrodes 14 (14*a* and 14*b*) in the same row of the heat generating resistors 126 is equal to a total area of the second electrodes 129 corresponding to the first electrodes 14. FIGS. 16A to 16C are schematic diagrams illustrating the electric field 130 generated between the first electrodes 14 and the second electrodes 129 when the first elution processing and the second elution processing are executed. FIG. 16A is a schematic plan view of the electric field 130. FIG. 16B is a schematic cross-sectional view of a portion including the first electrode 14*a* having a large area. FIG. 16C is a schematic cross-sectional view of a portion including the first electrode 14*b* having a small area.

In a case where the total area of the first electrodes 14 and the total area of the second electrodes 129 are approximately equal to each other, the current density of the surface of the first electrodes 14 and the current density of the surface of the second electrodes 129 become equal by executing the first elution processing and the second elution processing under equal voltage application conditions. With this configuration, an elution amount per unit area becomes equal at both electrodes 14 and 129, and thus the film thicknesses of the first electrode 14 and the second electrode 129 are decreased by a same amount. In order to improve the durability of the liquid discharge head, it is preferable that a difference between the elution amounts of the first electrode 14 and the second electrode 129 be small by making the first power amount used in the first elution processing and the second power amount used in the second elution processing be approximately equal to each other. It is more preferable that the first electrode 14 and the second electrode 129 be eluted equally.

Hereinafter, a specific example of the voltage application condition in the first elution processing and the second elution processing will be described. In the present exemplary embodiment, an area of one first electrode 14*a* is 400 $\mu m^2$ (20 $\mu m \times 20$ $\mu m$), and an area of one first electrode 14*b* is 196 $\mu m^2$ (14 $\mu m \times 14$ $\mu m$). The number of large first electrodes 14*a* and the number of small first electrodes 14*b* corresponding to one row of heat generation resistors 126 are 256 each. Thus, a total area of the first electrodes 14*a* and 14*b* is 152576 $m^2$ ((400 $\mu m^2 \times 256$ pcs)+(196 $\mu m^2 \times 256$ pcs)). On the other hand, an area of one second electrode 129 is 593 $\mu m^2$ (14 $\mu m \times 42.3$ $\mu m$). The number of second electrodes 129 corresponding to one row of heat generating resistors 126 is 256, and thus a total area of the second electrodes 129 is 151721 $\mu m^2$ (593 $\mu m^2 \times 256$ pcs). In other words, since the ratio between the total area of the first electrodes 14 and the total area of the second electrodes 129 is 1:1, the voltage application condition is set such that the ratio between the first power amount used for the first elution processing and the second power amount used for the second elution processing also becomes 1:1. Therefore, the scorched substance cleaning processing should be executed based on the waveforms of the applied voltage illustrated in FIG. 14.

By executing the scorched substance cleaning processing as described above, the film thicknesses of the first electrode 14 and the second electrode 129 are decreased equally, and thus durability of the liquid discharge head can be improved.

In each of the specific examples according to the above-described present exemplary embodiments, the scorched substance cleaning processing is executed such that a ratio between the first power amount used for the first elution processing and the second power amount used for the second elution processing becomes approximately the same as a ratio between the total area of the first electrodes 14 and the total area of the second electrodes 129. However, it is not necessary to set the condition which makes the ratio between the power amounts and the ratio between the areas be approximately equal. The cleaning processing can be executed such that the ratio between the first power amount and the second power amount becomes a ratio based on the ratio between the areas of the first electrode 14 and the second electrode 129. In the recording element substrate 10, there are approximately ±5% variations that occur in the areas of the first and the second electrodes 14 and 129 and in the wiring resistors connected to these electrodes 14 and 129. There is also a possibility of approximately 5% variations that occur in the applied voltage by the power source. In order to improve durability of the liquid discharge head by reducing a difference between the elution amounts of the electrodes 14 and 129 while taking the above-described variations into consideration, it is preferable that the following formula (1) be satisfied with respect to the power amounts and the areas of the electrodes:

$$0.850 < \frac{W_1 \times S_2}{W_2 \times S_1} < 1.15. \quad (1)$$

While the present disclose has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-131444, filed Jul. 16, 2019, which is hereby incorporated by reference herein in its entirety.

What is claimed is:

1. A method of cleaning a liquid discharge head including a heat generating resistor for discharging liquid inside a flow path, a first electrode having a first face exposed to the flow path, which covers the heat generating resistor, and a second electrode having a second face exposed to the flow path, the method of cleaning the liquid discharge head comprising:

first eluting the first electrode by applying voltage between the first electrode and the second electrode via a liquid; and second eluting the second electrode by applying voltage between the first electrode and the second electrode via the liquid;

wherein the first eluting and the second eluting are executed such that a ratio between a first electric power amount used in the first eluting and a second electric power amount used in the second eluting is based on a ratio between an area of the first face and an area of the second face.

2. The method of cleaning the liquid discharge head according to claim 1, wherein the liquid discharge head includes a plurality of the first electrodes electrically connected to each other and a plurality of the second electrodes electrically connected to each other, and wherein the first eluting and the second eluting are executed such that a ratio between the first electric power amount and the second electric power amount is based on a ratio between a total area of the first faces of the plurality of the first electrodes to which voltage is applied in the first eluting and a total area of the second faces of the plurality of the second electrodes to which voltage is applied in the second eluting.

3. The method of cleaning the liquid discharge head according to claim 2, wherein the total area of the second faces is smaller than the total area of the first faces, and wherein the second electric power amount is smaller than the first electric power amount.

4. The method of cleaning the liquid discharge head according to claim 3, wherein a value of voltage applied in the first eluting and a value of voltage applied in the second eluting are different from each other.

5. The method of cleaning the liquid discharge head according to claim 3, wherein a time while voltage is being applied in the first eluting and a time while voltage is being applied in the second eluting are different from each other.

6. The method of cleaning the liquid discharge head according to claim 2, wherein the total area of the second faces is larger than the total area of the first faces, and wherein the second electric power amount is larger than the first electric power amount.

7. The method of cleaning the liquid discharge head according to claim 2, wherein the total area of the first faces and the total area of the second faces are approximately equal, and wherein the first electric power amount and the second electric power amount are approximately equal.

8. The method of cleaning the liquid discharge head according to claim 2, wherein a following formula (1) is satisfied:

$$0.850 < \frac{W_1 \times S_2}{W_2 \times S_1} < 1.15, \quad (1)$$

where $W_1$ is the first electric power amount, $W_2$ is the second electric power amount, $S_1$ is the total area of the first faces, and $S_2$ is the total area of the second faces.

9. The method of cleaning the liquid discharge head according to claim 1, wherein the first eluting and the second eluting are alternately executed for a plurality of times.

10. The method of cleaning the liquid discharge head according to claim 1, wherein the first electrode and the second electrode are formed of a same platinum group material.

11. A liquid discharge apparatus comprising:

a liquid discharge head including a heat generating resistor for discharging liquid inside a flow path, a first electrode having a first face exposed to the flow path, which covers the heat generating resistor, and a second electrode having a second face exposed to the flow path; and a voltage application unit configured to apply voltage between the first electrode and the second electrode via a liquid in order to execute first elution processing for eluting the first electrode and second elution processing for eluting the second electrode, wherein the voltage application unit applies voltage such that a ratio between a first electric power amount used in the first elution processing and a second electric power amount used in the second elution processing is based on a ratio between an area of the first face and an area of the second face.

12. The liquid discharge apparatus according to claim 11, wherein the liquid discharge head includes a plurality of the first electrodes electrically connected to each other and a plurality of the second electrodes electrically connected to each other, and wherein the voltage application unit applies voltage such that a ratio between the first electric power amount and the second electric power amount is based on a ratio between a total area of the first faces of the plurality of the first electrodes to which voltage is applied in the first elution processing and a total area of the second faces of the plurality of the second electrodes to which voltage is applied in the second elution processing.

13. The liquid discharge apparatus according to claim 12, wherein, when the first electric power amount is $W_1$, the second electric power amount is $W_2$, the total area of the first faces is $S_1$, and the total area of the second faces is $S_2$, a following formula (2) is satisfied:

$$0.850 < \frac{W_1 \times S_2}{W_2 \times S_1} < 1.15, \quad (2)$$

where $W_1$ is the first electric power amount, $W_2$ is the second electric power amount, $S_1$ is the total area of the first faces, and $S_2$ is the total area of the second faces.

14. The liquid discharge apparatus according to claim 11, wherein the first elution processing and the second elution processing are alternately executed for a plurality of times.

15. The liquid discharge apparatus according to claim 11, wherein the first electrode and the second electrode are formed of a same platinum group material.

* * * * *